US011781260B2

(12) United States Patent
Lee

(10) Patent No.: US 11,781,260 B2
(45) Date of Patent: Oct. 10, 2023

(54) WASHING MACHINE

(71) Applicant: LG ELECTRONICS INC., Seoul (KR)

(72) Inventor: Phaljin Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 183 days.

(21) Appl. No.: 16/903,630

(22) Filed: Jun. 17, 2020

(65) Prior Publication Data

US 2021/0017688 A1 Jan. 21, 2021

(30) Foreign Application Priority Data

Jul. 16, 2019 (KR) ..... 10-2019-0085809

(51) Int. Cl.

| | |
|---|---|
| ***D06F 34/28*** | (2020.01) |
| ***D06F 34/30*** | (2020.01) |
| ***D06F 34/32*** | (2020.01) |
| ***D06F 34/14*** | (2020.01) |
| *D06F 33/00* | (2020.01) |

(52) U.S. Cl.

CPC ..... *D06F 34/30* (2020.02); *D06F 34/14* (2020.02); *D06F 34/32* (2020.02); *D06F 33/00* (2013.01)

(58) Field of Classification Search

CPC ..... D06F 34/28; D06F 34/30; D06F 34/32; D06F 2101/00

See application file for complete search history.

(56) References Cited

U.S. PATENT DOCUMENTS 5,694,793 A * 12/1997 Nishimura ..... D06F 34/32 68/12.27
2013/0290902 A1 10/2013 Martin et al.
2015/0169194 A1* 6/2015 Ban ..... G06F 3/04842 715/771
2015/0192915 A1 7/2015 Seo et al.

(Continued)

FOREIGN PATENT DOCUMENTS

EP 2426244 A2 3/2012
EP 2426244 A3 3/2012

(Continued)

OTHER PUBLICATIONS

Extended European Search Report in European Application No. 20179013.6, dated Aug. 17, 2020, 7 pages.

*Primary Examiner* — David G Cormier
(74) *Attorney, Agent, or Firm* — Fish & Richardson P.C.

(57) ABSTRACT

A washing machine includes an operation manipulation interface configured to control starting or stopping of an operation of the washing machine by a touch input of a user and provided as one button or a touch panel, an operation manipulation interface configured to recognize speech of the user using a speech recognition system and control components related to the operation of the washing machine based on the recognized speech of the user, an indicator including a character indicator configured to indicate a washing operation, a rinsing operation, and a spin-drying operation, respectively, and a graph indicator configured to indicate a running time or remaining time of the operation of the washing machine, and a power control configured to turn the power of the washing machine on or off by a touch input of the user.

18 Claims, 15 Drawing Sheets

(56) References Cited

U.S. PATENT DOCUMENTS

| | | | | |
|---|---|---|---|---|
| 2015/0330008 | A1* | 11/2015 | Yang | D06F 34/32 700/275 |
| 2015/0345065 | A1* | 12/2015 | Yang | D06F 34/28 700/275 |
| 2017/0260675 | A1 | 9/2017 | Kim et al. | |
| 2018/0291550 | A1 | 10/2018 | Niu et al. | |
| 2019/0214009 | A1 | 7/2019 | An et al. | |

FOREIGN PATENT DOCUMENTS

| | | |
|---|---|---|
| EP | 3502867 | 6/2019 |
| KR | 100421157 | 3/2004 |
| WO | WO2019031734 | 2/2019 |

* cited by examiner

RELATED ART

WASHING MACHINE

CROSS-REFERENCE TO RELATED APPLICATION

This present application claims benefit of priority to Korean Patent Application No. 10-2019-0085809, entitled "A Washing Machine," filed on Jul. 16, 2019, the entire disclosure of which is incorporated herein by reference.

TECHNICAL FIELD

The present disclosure relates to a washing machine. More particularly, the present disclosure relates to a washing machine capable of controlling, by speech, a basic operation such as washing, rinsing, and spin-drying, and a detailed operation such as a temperature of washing water and an intensity of performance for each basic operation of washing, and having an indicator that allows a user to intuitively and easily recognize information such as a selected type of operation of the washing machine, or a running time or remaining time of the operation of the washing machine.

BACKGROUND

A washing machine is an apparatus for washing laundry, such as contaminated clothing. The washing machine generally includes, for example, a water tub in which water is filled, a drum rotatably installed inside the water tub and configured to receive laundry, and a motor configured to generate a driving force for rotating the drum. The washing machine performs the basic operation such as washing, rinsing, spin-drying, and drying while adjusting a time, an intensity, a temperature, and the like, depending on the weight of the laundry, the material of the laundry, or the like. Therefore, the user needs to manipulate in detail the time, the intensity, the temperature, and the like, to be performed for each operation of the washing machine.

FIG. 1 is a view illustrating a manipulation interface of a washing machine in related art.

As shown in FIG. 1, the conventional washing machine is provided with a manipulation interface configured to allow manipulation of a basic operation such as washing, rinsing, spin-drying, and drying; and a complicated manipulation interface configured to allow selection of a detailed operation such as an operating time, an intensity, a temperature, and a course for each basic operation.

As described above, since the conventional washing machine has a plurality of manipulation interfaces, it is complicated and difficult for a user to manipulate the washing machine. In addition, since the conventional washing machine is provided with an indicator configured to indicate information about an operation of the washing machine with the complicated manipulation interface, it is not easy for the user to recognize information about the operation of the washing machine.

As related art, Korean Patent Registration No. 10-0421157 discloses a washing machine capable of changing a layout of a display so that a user may relatively conveniently manipulate the operation of the washing machine. However, Korean Patent Registration No. 10-0421157 also requires the user to manipulate multiple input interfaces in order to manipulate the detailed operation of the washing machine. Therefore, it is necessary to enable more simple and convenient manipulation of the operation of the washing machine.

In addition, Korean Patent Registration No. 10-0421157 discloses a configuration in which the user may change a layout of a screen of the display, but information about the operation of the washing machine indicated on the display is mainly composed of characters. Therefore, it is not easy for the user to recognize the information intuitively.

SUMMARY

The present disclosure is directed to addressing an issue in which a user manipulates a complicated washing machine, and thus, an operation suitable for washing laundry is not selected, thereby causing damage to the laundry.

The present disclosure is further directed to addressing an issue in which an indicator is disposed with a complicated manipulation interface, resulting in reduced readability of the indicator and making it difficult for the user to easily recognize information related to the operation of the washing machine.

The present disclosure is still further directed to addressing an issue in which due to the complicated manipulation interface outside the washing machine, the user feels that the area where the manipulation interface is installed is not neat.

Aspects of the present disclosure are not limited to those mentioned above, and other aspects not mentioned above may be clearly understood by those skilled in the art from the following description.

According to an embodiment of the present disclosure, a washing machine includes a simple and convenient manipulation interface and a speech recognition module.

Specifically, the washing machine may include: an input interface configured simply and conveniently as a single input and configured to control starting or stopping of an operation of the washing machine; an operation manipulation interface configured to recognize speech of a user and control the operation of the washing machine; and an indicator including a symbol indicator and a graph indicator and configured to allow the user to easily and intuitively recognize information related to the operation of the washing machine, wherein the graph indicator may be configured to enable lighting freely for each section thereof with one or more colors to indicate an operating time of the operation of the washing machine.

In addition, the symbol indicator may enable lighting independently to indicate a basic operation in progress.

In addition, the symbol indicator may be disposed side by side with and adjacent to the graph indicator, so that the basic operation may be indicated by lighting of the graph indicator.

In addition, the input interface may be a circular shape and the graph indicator may be a circular ring shape, so that the manipulation interface of the washing machine may be configured neatly.

In addition, the symbol indicator may further indicate a drying operation as the basic operation of the operation of the washing machine.

According to one embodiment of the present disclosure, a washing machine includes a display including a power screen configured to control power of the washing machine by a touch input of a user, an operation screen configured to control starting of an operation of the washing machine by a touch input of the user, and an indicator screen configured to indicate an operating time of the operation of the washing machine by a graph of which each section is lit with one or more colors and control stopping the operation of the washing machine by a touch input of the user, wherein the screens of the display are changeable; and an operation manipulation interface configured to control the operation of the washing machine by recognizing speech of the user, wherein the display is simply and conveniently configured in the form of a smart key.

According to another embodiment of the present disclosure, a washing machine is simply and conveniently configured to include one power control, an operation manipulation interface configured to control an operation of the washing machine by recognizing speech of a user, and a lighting in the form of a graph and configured to enable lighting for each section thereof.

In addition, the power control may be a circular shape and the lighting may be a circular ring shape surrounding a circumference of the power control, so that the manipulation interface of the washing machine may be configured neatly.

In addition, the lighting may enable lighting with one or more colors, thereby indicating an operating time of the operation of the washing machine.

In addition, the washing machine according to an embodiment of the present disclosure may include a sensor, so that the indicator, the display, and the lighting may be activated in response to the user approaching the washing machine.

Details of other embodiments of the present disclosure are included in the detailed description and drawings.

According to the present disclosure, basic operation and detailed operation of the washing machine may be manipulated using a simple and convenient manipulation interface and a speech recognition module. As a result, it is possible to easily and conveniently manipulate the operation of the washing machine, not only for general users but also for users who are not able to move comfortably or users who do not have free hands.

In addition, according to the present disclosure, it is possible to simply and conveniently manipulate the operation of the washing machine, so that the user may manipulate the detailed operation without mistakes. As a result, it is possible to prevent the laundry from being damaged.

In addition, according to the present disclosure, an indicator may be disposed with a simple and convenient manipulation interface and be indicated by a graph that may be intuitively and easily recognized. As a result, the user may easily and conveniently recognize information related to the operation of the washing machine.

In addition, according to the present disclosure, the manipulation interface of the washing machine may be configured simply and conveniently. As a result, it is possible to give the user a feeling that the washing machine and the area where the manipulation interface is installed are neat and comfortable.

In addition, according to the present disclosure, the washing machine may be provided with a sensor, so that the light of the indicator may be turned off except when the user approaches the washing machine. As a result, it is possible to prevent the user's sleep from being disturbed or fatigue to the user's eyes.

BRIEF DESCRIPTION OF DRAWINGS

The above and other aspects, features, and advantages of the present disclosure will become apparent from the detailed description of the following aspects in conjunction with the accompanying drawings.

DETAILED DESCRIPTION

Hereinafter, preferred embodiments of the present disclosure will be described in detail with reference to the accompanying drawings and the following description. However, the present disclosure is not limited to the embodiments described herein and may be embodied in other forms. Rather, the embodiments disclosed herein are provided to ensure that the disclosed contents are thorough and complete and that the spirit of the present disclosure is sufficiently conveyed to those skilled in the art. Throughout the specification, the same reference numbers indicate the same components. Meanwhile, the terms used herein are for describing the embodiments and are not intended to limit the present disclosure. As used herein, the singular forms "a," "an," and "the" may be intended to include the plural forms as well, unless the context clearly indicates otherwise. The terms "comprises," "comprising," "includes," "including," "containing," "has," "having" or other variations thereof are inclusive and therefore specify the presence of stated features, integers, steps, operations, elements, and/or components, but do not preclude the presence or addition of one or more other features, integers, steps, operations, elements, components, and/or a combination thereof.

Hereinafter, a washing machine according to a first embodiment of the present disclosure will be described.

Figure 1:
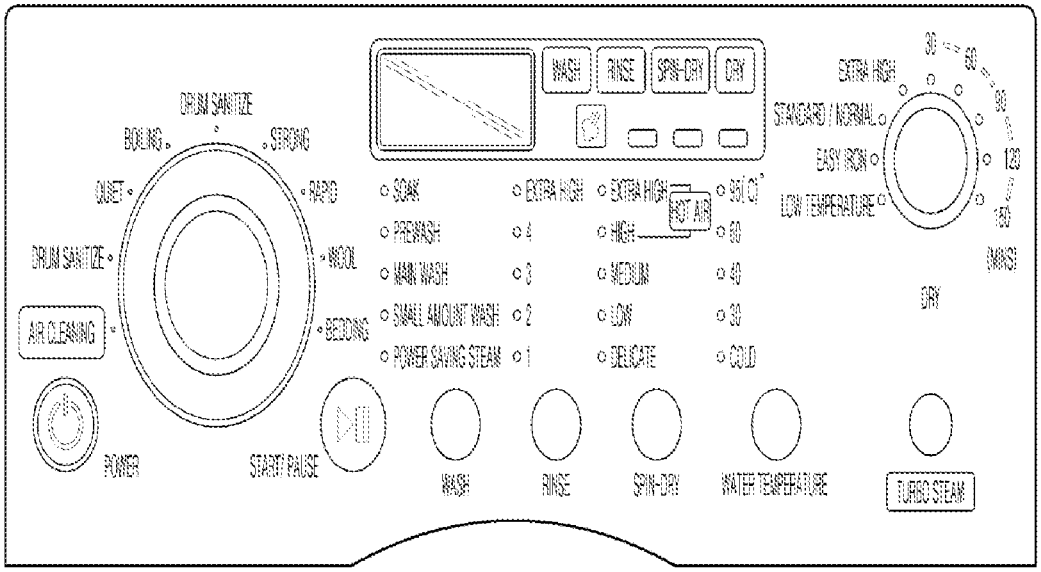
FIG. 1 is a view illustrating a manipulation interface of a washing machine in related art.
Figure 2:
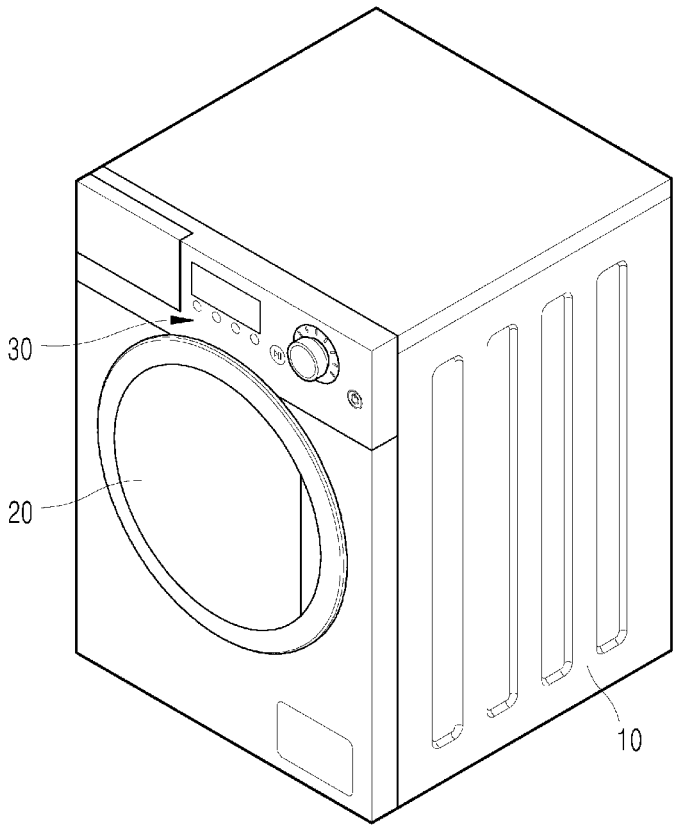
FIG. 2 is a view illustrating an exterior of a typical washing machine.
Figure 3:
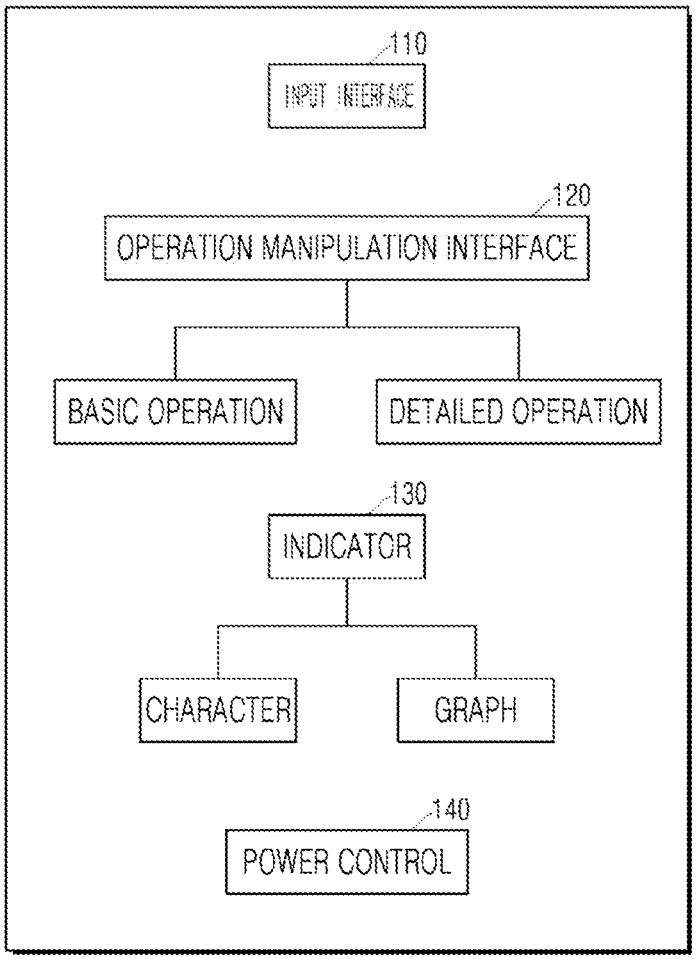
FIG. 3 is a block diagram illustrating a manipulation interface of a washing machine according to a first embodiment of the present disclosure.

FIG. 2 is a view illustrating an exterior of a typical washing machine, and FIG. 3 is a block diagram illustrating a manipulation interface of the washing machine according to the first embodiment of the present disclosure.

Referring to FIG. 2, the typical washing machine includes a main body 10, a door 20, and a manipulation interface 30. The manipulation interface 30 is provided on the outer surface of the main body 10. The manipulation interface 30 may be manipulated to control all operations of the washing machine (hereinafter referred to as the operation of the washing machine), including operations such as a washing operation, a rinsing operation, a spin-drying operation, and a drying operation (hereinafter referred to as a basic operation) and operations that control a time, an intensity, a temperature, and the like, to be performed for each basic operation (hereinafter referred to as a detailed operation).

Referring to FIG. 3, the manipulation interface of the washing machine according to the first embodiment of the present disclosure includes an input interface 110, an operation manipulation interface 120, an indicator 130, and a power control 140.

First, a configuration of the input interface 110 will be described.

The input interface 110 may be formed as a button, a touch panel, or the like that responds when a user presses or touches it with a predetermined force (hereinafter referred to as a touch input). In addition, the input interface 110 may be installed on the outer surface of the main body 10 so that the user may control starting and stopping of the operation of the washing machine.

Specifically, the operation of the washing machine may be started when the user performs a touch input on the input interface 110, and while the operation of the washing machine is being performed, the operation of the washing machine may be stopped when the user performs a touch input on the manipulation interface 110. The input interface 110 may be installed on the main body 10 and have a simple shape. To illustrate, the input interface 110 may have a known shape such as a circular shape, a square shape, or an elliptical shape.

Next, a configuration of the operation manipulation interface 120 will be described.

The operation manipulation interface 120 may recognize speech of the user using a speech recognition control system, and control the basic operation and the detailed operation of the washing machine based on the recognized speech of the user. To illustrate, the operation manipulation interface 120 may recognize the speech of the user using a speech recognition module 170 including a speech input interface 170-1 and a speech signal processor 170-2, and control components related to the operation of the washing machine using a controller 150 based on the recognized speech of the user.

Figure 4:
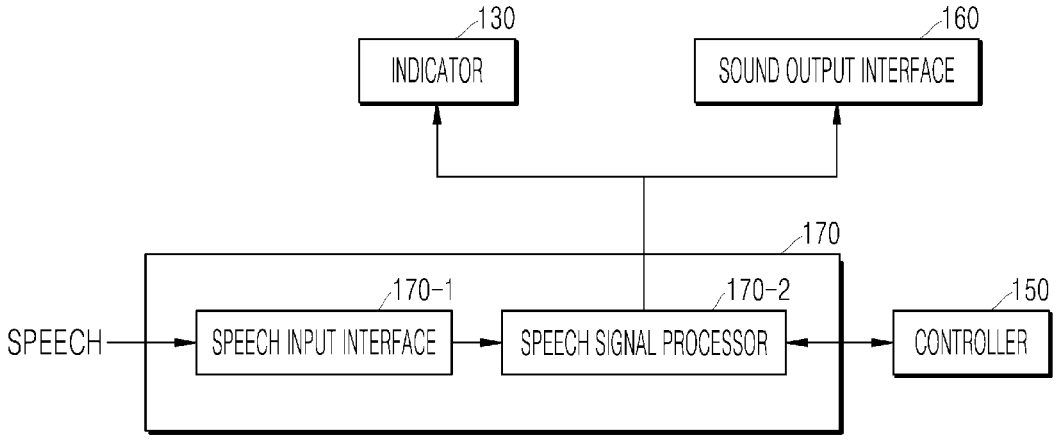
FIG. 4 is a block diagram illustrating an example of a speech recognition control system of the washing machine according to the first embodiment of the present disclosure.

FIG. 4 is a block diagram illustrating an example of a speech recognition control system of the washing machine according to the first embodiment of the present disclosure.

Specifically, referring to FIG. 4, when the user speaks a speech command near the washing machine, the speech input interface 170-1 included in the speech recognition module 170 receives a speech signal and transmits the received speech signal to the signal processor 170-2. For example, the speech input interface 170-1 may include an electric circuit, a microphone, a signal processor, a receiver, a transmitter, or a software program.

The speech signal processor 170-2 detects the command for controlling the operation of the washing machine based on the speech signal received from the speech input interface 170-1, and then transmits the detected command to the controller 150 capable of controlling the components related to the operation of the washing machine.

The controller 150 controls the components related to the operation of the washing machine based on the command received from the speech signal processor 170-2, and then transmits the control result of the operation of the washing machine to the speech signal processor 170-2. The speech signal processor 170-2 outputs the control result received from the controller 150 to the indicator 130 or a sound output interface 160 capable of outputting sound. The control result of the operation of the washing machine may be information about the basic operation or the detailed operation selected by the user.

The received control result of the operation of the washing machine may be indicated on the indicator 130 for the user to recognize, or may be outputted through the sound output interface 160 in a language that the user may recognize. The sound output interface 160 may be formed as a known speaker, microphone, or the like provided in a conventional washing machine.

The user may input a speech command related to the operation of the washing machine to the operation manipulation interface 120, and then perform a touch input on the input interface 110. By doing so, the operation of the washing machine may be started. In addition, the user may perform a touch input on the input interface 110 to start the operation of the washing machine, and then input a speech command related to the operation of the washing machine to the operation manipulation interface 120.

Meanwhile, when the user simply operates the washing machine by performing a touch input on the input interface 110, without inputting a speech command related to the operation of the washing machine to the operation manipulation interface 120, the washing machine may perform a predetermined basic operation at a predetermined temperature, intensity, and time.

Next, a configuration of the indicator 130 will be described.

The indicator 130 may provide the user with information related to the operation of the washing machine, and may be composed of various types of devices such as a liquid crystal display (LCD), a light-emitting diode (LED), or the like. In addition, the indicator 130 may include a symbol indicator having a shape such as a character and a figure, and a graph indicator having a graph shape. The indicator 130 may indicate that the operation of the washing machine has ended or that the washing machine is recognizing speech of the user, by lighting such as blinking.

Specifically, the graph indicator is a means for indicating a running time or remaining time (hereinafter, referred to as an operating time) of the operation of the washing machine in progress, and may be formed in various shapes such as a curved line or a straight line.

In order to indicate the operating time of the operation of the washing machine, the graph indicator may be configured such that sections of an arbitrary range of the graph indicator may be independently lit with one or more colors. To illustrate, when the graph indicator has a circular ring shape, the graph indicator may be configured such that the circular ring shape is gradually filled with a specific color in a clockwise or counterclockwise direction over time. In addition, the graph indicator may be configured such that the circular ring shape is completely filled with a specific color when the operating time of the operation of the washing machine reaches 1 hour. In addition, the graph indicator may be configured such that the circular ring shape is gradually filled again with a different color when the operating time of the operation of the washing machine exceeds 1 hour.

In addition, the symbol indicator is a means for indicating a type of the basic operation selected by the user of the washing machine or a type of the basic operation in progress, and may have character shapes such as Korean characters. To illustrate, the symbol indicator may have shapes of the Korean characters corresponding to "washing," "rinsing," "spin-drying," and "drying," and the like The symbol indicator may be configured to be lit separately from the graph indicator, and may be disposed side by side with and adjacent to the graph indicator, so that information about the basic operation is indicated by lighting of the graph indicator.

Figure 5:
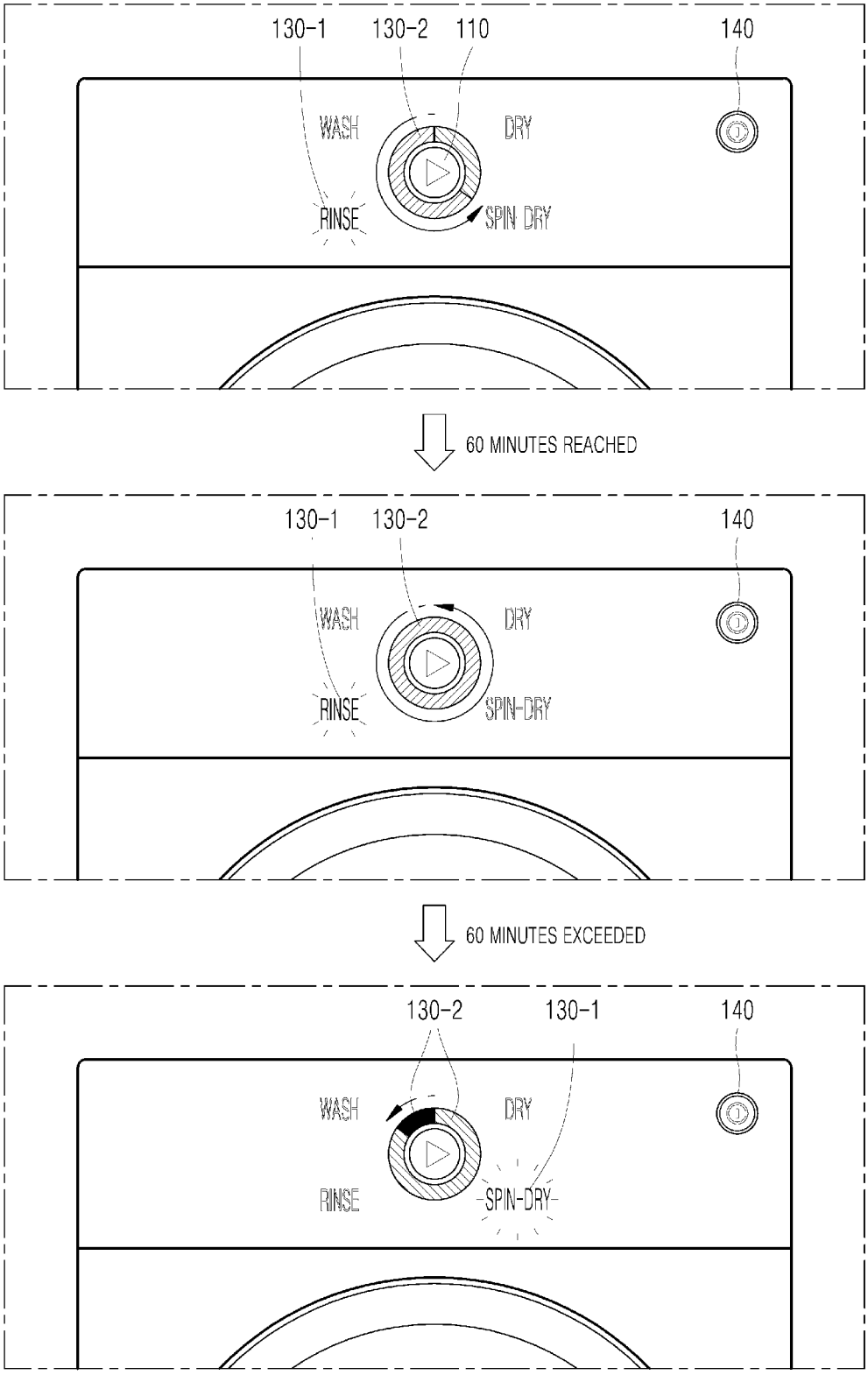
FIG. 5 is a view illustrating an example of the manipulation interface of FIG. 3, in which a character indicator is separately lit and an indicator has a circular ring shape.
Figure 6:
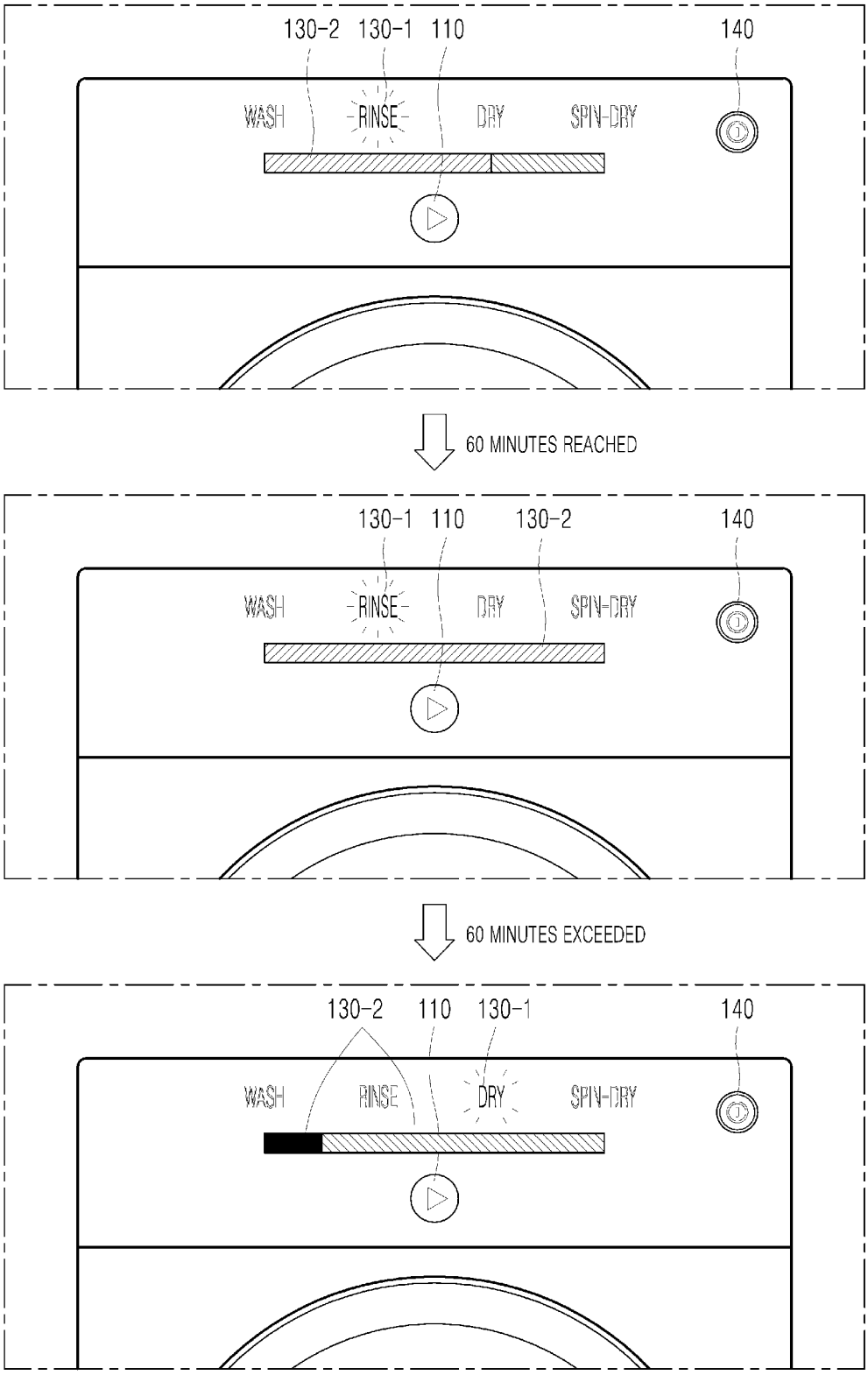
FIG. 6 is a view illustrating an example of the manipulation interface of FIG. 3, in which a character indicator is separately lit and an indicator has a rectangular shape.

FIG. 5 is a view illustrating an example of the manipulation interface of FIG. 3, in which a symbol indicator is separately lit and an indicator has a circular ring shape, and FIG. 6 is a view illustrating an example of the manipulation interface of FIG. 3, in which a symbol indicator is separately lit and an indicator has a rectangular shape.

Referring to FIGS. 5 and 6, examples will be described in which the symbol indicator is lit separately from the graph indicator to indicate information about the basic operation.

Referring to FIG. 5, the graph indicator has a first circular ring shape 130-2 surrounding a circumference of the circular-shaped input interface 110, and is configured such that as the operating time of the washing machine passes, the first circular ring shape is gradually filled with a color A in a counterclockwise direction. Further, the graph indicator is configured such that when the operating time of the washing machine reaches 60 minutes, the first circular ring shape is completely filled with color A, and when the operating time of the washing machine exceeds 60 minutes, the first circular ring shape is gradually filled with a color B in a counterclockwise direction.

Referring to FIG. 6, the graph indicator has a first rectangular shape that is long in the horizontal direction, and is configured such that as the operating time of the washing machine passes, the first rectangular shape is gradually filled with a color C in one direction horizontally. Further, the graph indicator is configured such that when the operating time of the washing machine reaches 60 minutes, the first rectangular shape is completely filled with color C, and when the operating time of the washing machine exceeds 60 minutes, the first rectangular shape is gradually filled with a color D in one direction horizontally.

Meanwhile, referring to FIGS. 5 and 6, the symbol indicator 130-1 is disposed on the periphery of the graph indicator and is configured to indicate the basic operation in progress or the selected basic operation by being lit separately from the graph indicator. To illustrate, when indicating a rinsing operation, the symbol indicator indicating 'rinsing' may be lit. In addition, when indicating a plurality of basic operations, the symbol indicators indicating corresponding operations may be lit.

Further, when the symbol indicator is lit separately from the graph indicator to indicate information about the basic operation, the symbol indicator may be freely disposed regardless of the position of the graph indicator.

Figure 7:
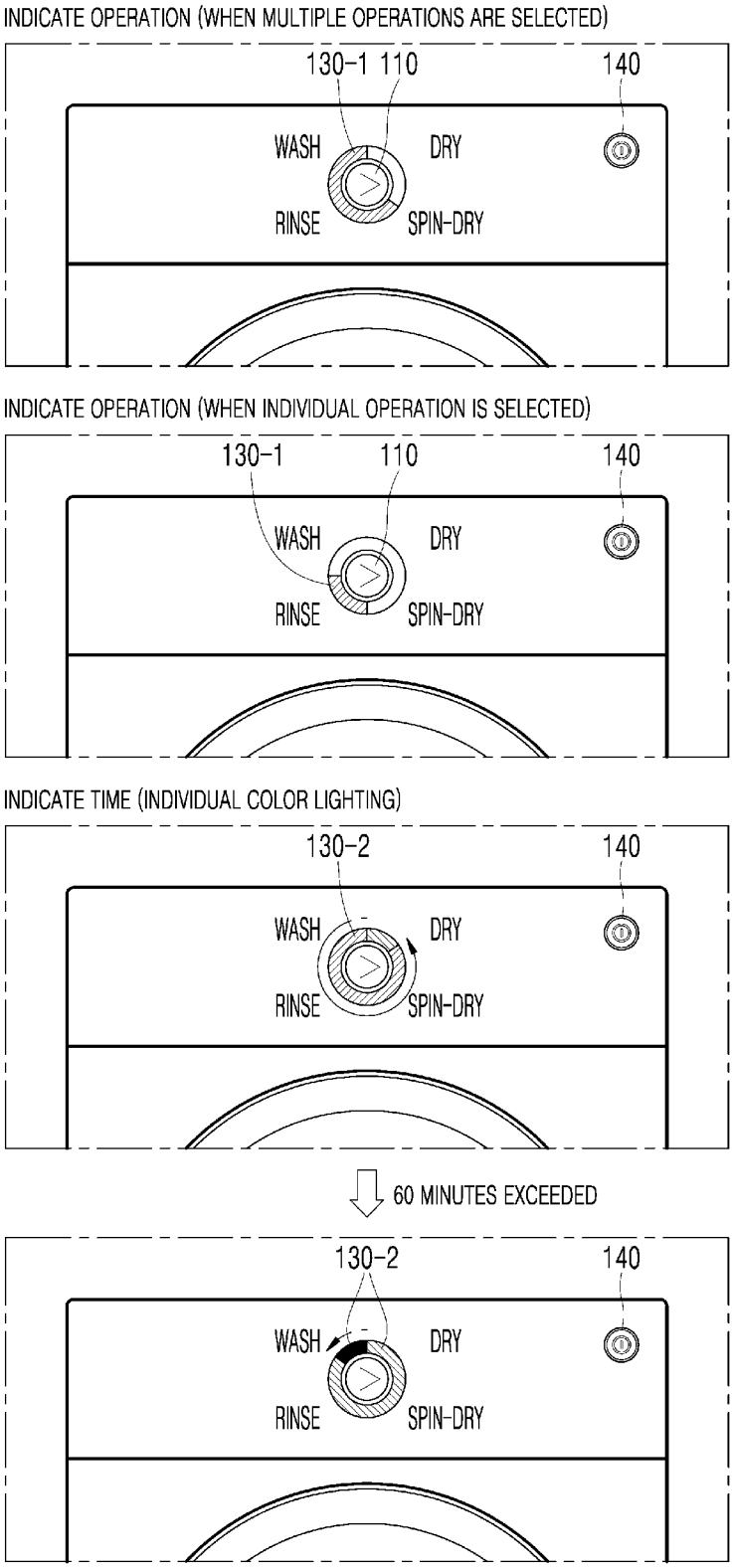
FIG. 7 is a view illustrating an example of the manipulation interface of FIG. 3, in which one lighting is provided and an indicator has a circular ring shape.
Figure 8:
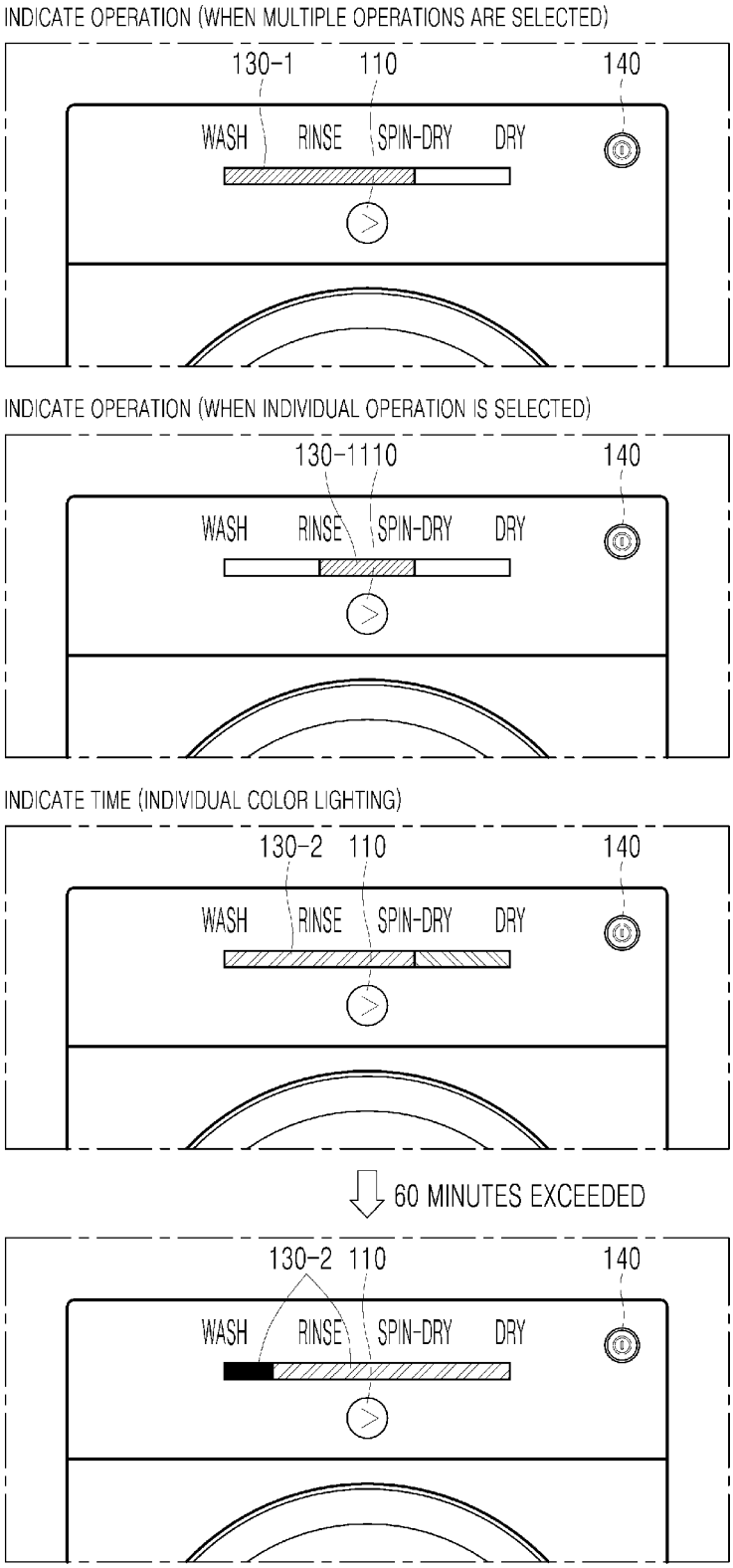
FIG. 8 is a view illustrating an example of the manipulation interface of FIG. 3, in which one lighting is provided and an indicator has a rectangular shape.

FIG. 7 is a view illustrating an example of the manipulation interface of FIG. 3, in which one lighting is provided and an indicator has a circular ring shape, and FIG. 8 is a view illustrating an example of the manipulation interface of FIG. 3 in which one lighting is provided and an indicator has a rectangular shape.

Referring to FIGS. 7 and 8, examples will be described in which information about the basic operation and the operation time are indicated by lighting of the graph indicator.

Referring to FIG. 7, the graph indicator has a second circular ring shape surrounding a circumference of the circular-shaped input interface 110, and is configured such that as the operating time of the washing machine passes, the second circular ring shape is gradually filled with a color E in a counterclockwise direction. Further, the graph indicator is configured such that when the operating time of the washing machine reaches 60 minutes, the second circular ring shape is completely filled with color E, and when the operating time of the washing machine exceeds 60 minutes, the second circular ring shape is gradually filled with a color F in the counterclockwise direction.

Referring to FIG. 8, the graph indicator has a second rectangular shape that is long in the horizontal direction, and is configured such that as the operating time of the washing machine passes, the second rectangular shape is gradually filled with a color G in one direction horizontally. Further, the graph indicator is configured such that when the operating time of the washing machine reaches 60 minutes, the second rectangular shape is completely filled with color G, and when the operating time of the washing machine exceeds 60 minutes, the second rectangular shape is gradually filled with a color H in one direction horizontally.

Meanwhile, referring to FIGS. 7 and 8, the symbol indicator is disposed side by side with and adjacent to the graph indicator. Further, the basic operation selected by the user is indicated by lighting a section indicating the selected basic operation, on the graph indicator adjacent to the symbol indicator.

To illustrate, when the rinsing operation is selected by the user, a section indicating 'rinsing,' on the circular ring shape or the rectangular shape of the graph indicator adjacent to the symbol indicator, may be lit with a specific color.

In addition, when a plurality of basic operations are selected by the user, sections indicating the plurality of basic operations, on the circular ring shape or the rectangular shape of the graph indicator adjacent to the symbol indicator, may be lit with specific colors.

When the symbol indicator indicates information about the basic operation by lighting of the graph indicator, it is preferable that the symbol indicator is disposed side by side with and adjacent to the graph indicator.

Next, a configuration of the power control 140 will be described.

The power control 140 may be installed on the outer surface of the main body 10 as a button, a touch panel, or the like that responds to a touch input of the user, and when the user performs a touch input on the power control 140, the power of the washing machine may be turned on or off.

The power control 140 may have a known shape such as a circular shape, a square shape, or an elliptical shape, and the power control 140 may adopt a configuration and shape of a power control of a conventional washing machine.

Hereinafter, a washing machine according to a second embodiment of the present disclosure will be described.

Figure 9:
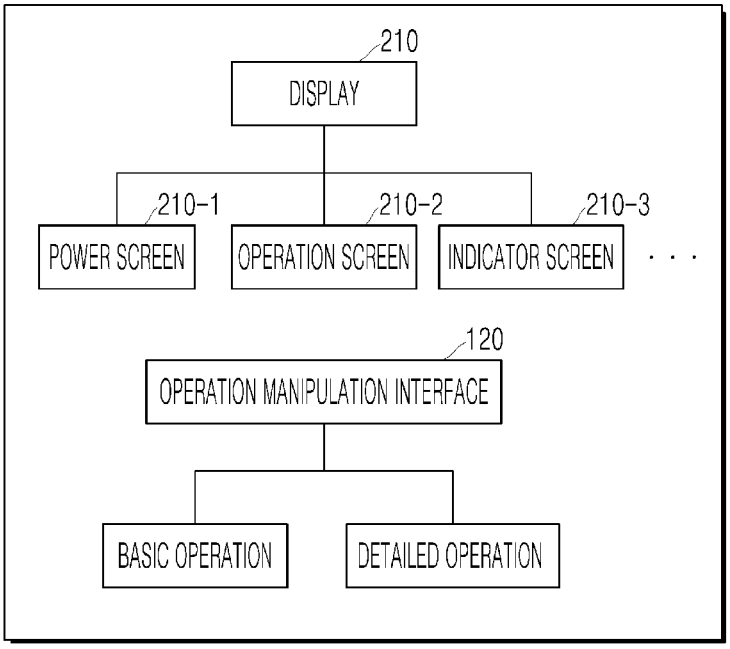
FIG. 9 is a block diagram illustrating a manipulation interface of a washing machine according to a second embodiment of the present disclosure.

FIG. 9 is a block diagram illustrating a manipulation interface of the washing machine according to the second embodiment of the present disclosure.

Referring to FIG. 9, the manipulation interface of the washing machine according to the second embodiment of the present disclosure includes a display 210 and an operation manipulation interface 120.

First, a configuration of the display 210 will be described.

The display 210 may be formed as a touch panel, a touch screen, or the like that responds to a touch input of a user, and may be installed on the outer surface of the main body 10 to enable a touch input of the user. The display 210 may have a known shape such as a circular shape, a square shape, or an elliptical shape.

The display 210 may indicate that the operation of the washing machine has ended or that the washing machine is recognizing speech of the user, by lighting such as blinking.

The display 210 may be in the form of a smart key that may change the screen of the display 210 to a screen for controlling the operation of the washing machine or a screen for displaying information related to the operation of the washing machine, based on a touch input of the user.

To illustrate, the display 210 may include a power screen 210-1 configured to control the power of the washing machine to turn on or off, an operation screen 210-2 configured to start the operation of the washing machine based on a touch input of the user, and an indicator screen 210-3 configured to display information related to the operation of the washing machine in progress and to stop the operation of the washing machine based on a touch input of the user, and the screens of the display 210 may be changed based on a touch input of the user.

Figure 10:
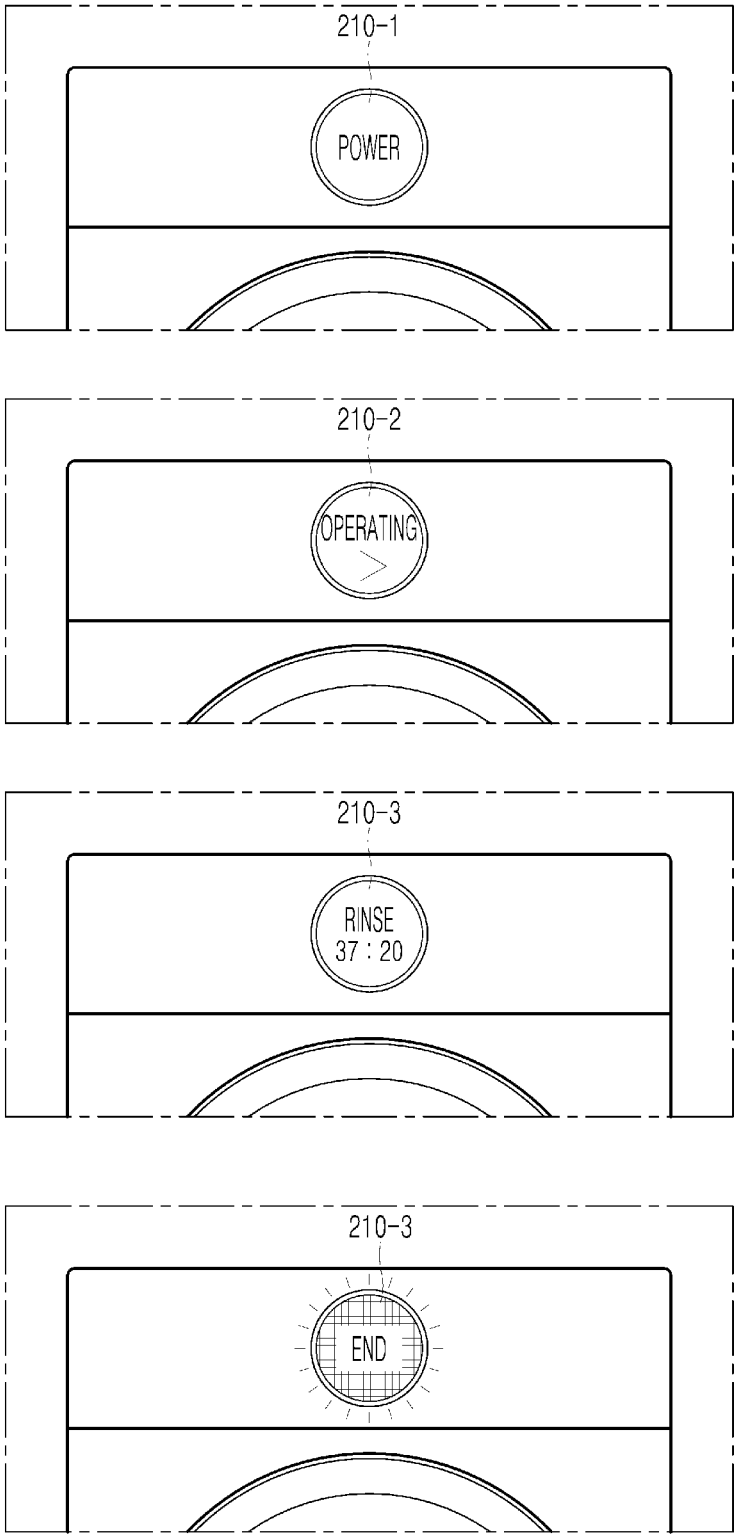
FIG. 10 is a view illustrating an example of the manipulation interface of FIG. 9, having a display in the form of a smart key.

FIG. 10 is a view illustrating an example of the manipulation interface of FIG. 9, having a display in the form of a smart key.

Referring to FIG. 10, an example of the display 210 in the form of a smart key will be described.

Referring to FIG. 10, when the washing machine is in a standby state, the display 210 may indicate the power screen 210-1. When the user performs a touch input on the power screen 210-1 for washing, the power of the washing machine is turned on.

When the power of the washing machine is turned on, the screen of the display 210 may be changed to the operation screen 210-2.

When the user performs a touch input on the operation screen 210-2, the operation of the washing machine is started.

The user may perform the touch input on the operation screen 210-2 after speaking a command related to the operation of the washing machine, rather than first performing the touch input on the operation screen 210-2, to start the operation of the washing machine. Alternatively, the user may perform the touch input on the operation screen 210-2 to start the operation of the washing machine, and then speak the command related to the operation of the washing machine to control the operation of the washing machine.

Meanwhile, when the user operates the washing machine not by speaking the command but by only performing the touch input on the operation screen 210-2, the washing machine may perform a predetermined basic operation at a predetermined temperature, intensity, and time.

When the operation the washing machine is started, the screen of the display 210 may be changed to the indicator screen 210-3.

Similar to the graph indicator, the indicator screen 210-3 may be configured to indicate the operating time of the operation of the washing machine by a graph of which each section is freely lit with one or more colors.

While the indicator screen 210-3 is displayed, the user may change the detailed operation of the operation of the washing machine by controlling the operation manipulation interface 120 by speech, and may stop the operation of the washing machine in progress. To illustrate, in order to stop the operation of the washing machine in progress, the user may perform a touch input on the indicator screen 210-3 or speak a speech command to stop the operation of the washing machine.

When all operations of the washing machine in progress are completed, the indicator screen 210-3 may indicate the end of the operation of the washing machine with a character or the like. To illustrate, the indicator screen 210-3 may indicate the end of the operation of the washing machine by indicating blinking lighting, indicating the character signifying the end of the operation, changing the screen to a specific color, or the like.

When the user confirms the end of the operation of the washing machine indicated on the indicator screen 210-3 and opens the door 20 of the washing machine to collect laundry, the screen of the display 210 may be changed to the power screen 210-1. At this time, when the user presses or touches the power screen 210-1 for a long time, the power of the washing machine may be turned off.

Next, a configuration of the operation manipulation interface 120 will be described.

The operation manipulation interface 120 may recognize the speech of the user using a speech recognition control system, and control the basic operation and the detailed operation of the washing machine based on the recognized speech of the user. The operation manipulation interface 120 may be configured in the same manner as the operation manipulation interface 120 of the washing machine according to the first embodiment of the present disclosure described above.

Figure 11:
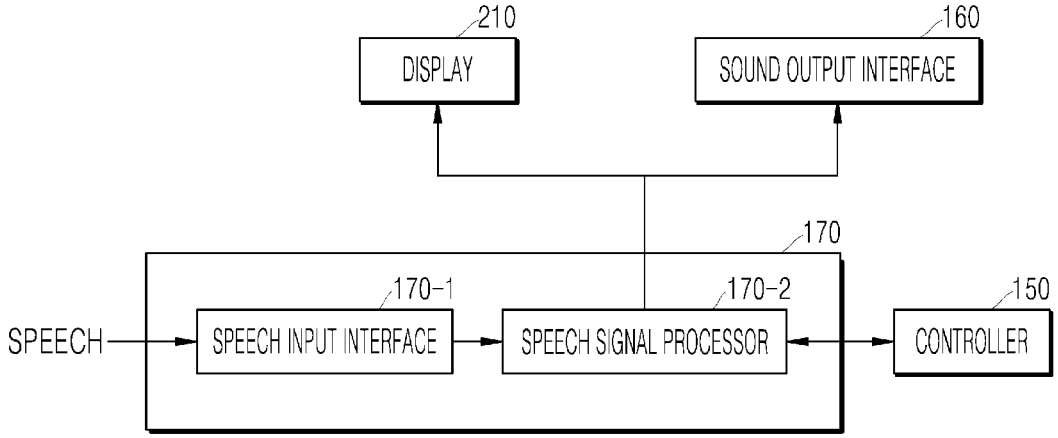
FIG. 11 is a block diagram illustrating an example of a speech recognition control system of the washing machine according to the second embodiment of the present disclosure.

FIG. 11 is a block diagram illustrating an example of a speech recognition control system of the washing machine according to the second embodiment of the present disclosure.

The speech recognition control system shown in FIG. 11 may be configured in the same manner as the speech recognition control system according to the first embodiment of the present disclosure described above, except for the configuration that indicates a control result of the operation of the washing machine. Therefore, only the differences between these embodiments will be described.

Referring to FIG. 11, when the controller 150 controls the operation of the washing machine based on a speech command of the user and then transmits the control result of the operation of the washing machine to the speech signal processor 170-2, the speech signal processor 170-2 transmits the control result received from the controller 150 to the display 210 or the sound output interface 160.

The received control result may be indicated on the indicator screen 210-3 for the user to recognize or be outputted through the sound output interface 160 in a language that the user may recognize.

Hereinafter, a washing machine according to a third embodiment of the present disclosure will be described.

Figure 12:
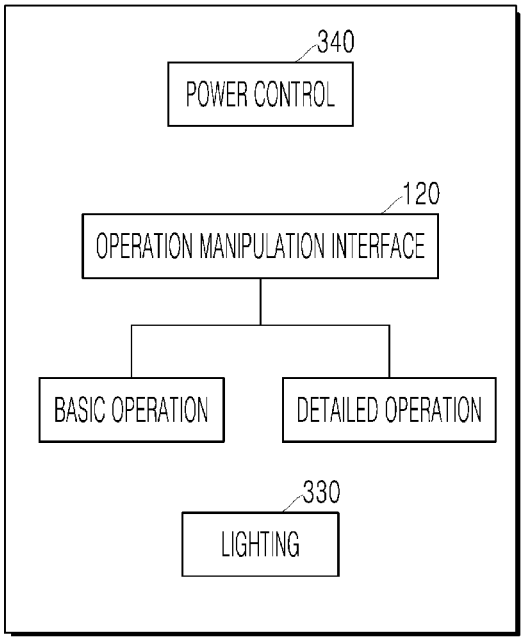
FIG. 12 is a block diagram illustrating a manipulation interface of a washing machine according to a third embodiment of the present disclosure.

FIG. 12 is a block diagram illustrating a manipulation interface of the washing machine according to the third embodiment of the present disclosure.

Referring to FIG. 12, the manipulation interface of the washing machine according to the third embodiment of the present disclosure includes a power control 340, an operation manipulation interface 120, and a lighting 330.

First, a configuration of the power control 340 will be described.

The power 340 control may be installed on the outer surface of the main body 10 as a button, a touch panel, or the like that responds to a touch input of the user, and when the user performs a touch input on the power control 340, the power of the washing machine may be turned on or off.

The power 340 control may have a known shape such as a circular shape, a square shape, or an elliptical shape, and the power control 340 may adopt a configuration and shape of a power control of a conventional washing machine.

Next, a configuration of the operation manipulation interface 120 will be described.

The operation manipulation interface 120 may recognize the speech of the user using a speech recognition control system, and control the basic operation and the detailed operation of the washing machine based on the recognized speech of the user. The operation manipulation interface 120 may be configured in the same manner as the operation manipulation interface 120 of the washing machine according to the first embodiment of the present disclosure described above.

Figure 13:
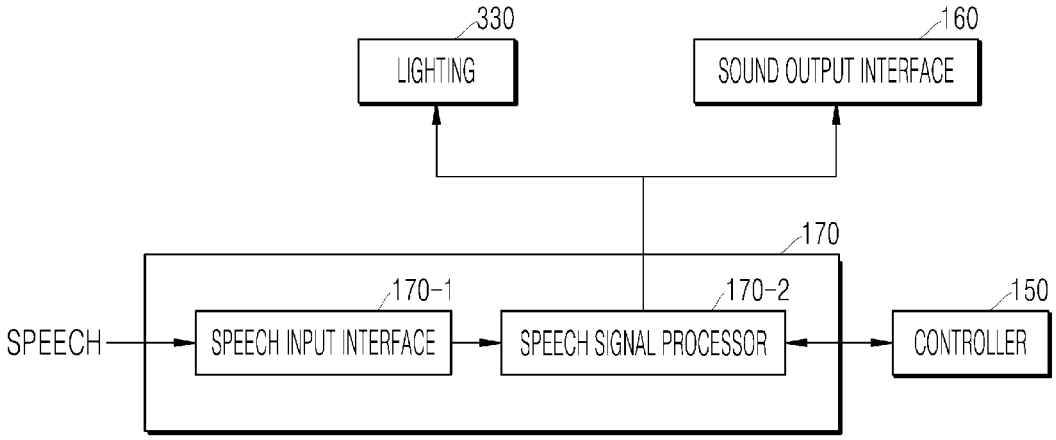
FIG. 13 is a block diagram illustrating an example of a speech recognition control system of the washing machine according to the third embodiment of the present disclosure.

FIG. 13 is a block diagram illustrating an example of a speech recognition control system of the washing machine according to the third embodiment of the present disclosure.

The speech recognition control system shown in FIG. 13 may be configured in the same manner as the speech recognition control system according to the first embodiment of the present disclosure described above, except for the configuration that indicates a control result of the washing machine. Therefore, only the differences between these embodiments will be described.

Referring to FIG. 13, when the controller 150 controls the operation of the washing machine based on a speech command of the user and then transmits the control result of the operation of the washing machine to the speech signal processor 170-2, the speech signal processor 170-2 transmits the control result received from the controller 150 to the lighting 330 or the sound output interface 160.

The received control result may be indicated on the lighting 330 for the user to recognize the operating time of the operation of the washing machine or the like, or be outputted through the sound output interface 160 in a language that the user may recognize.

The user may perform a touch input on the power control 340 to turn on the power of the washing machine, and then control, by speech, the operation of the washing machine through the operation manipulation interface 320.

Next, a configuration of the lighting 330 will be described.

The lighting 330 may have a structure of a closed loop surrounding the power control 340. When the power control 340 has a circular shape, the lighting 330 may have a circular ring shape. Further, the lighting 330 may be configured to enable lighting freely for each section thereof in order to indicate simple information related to the operation of the washing machine.

Figure 14A:
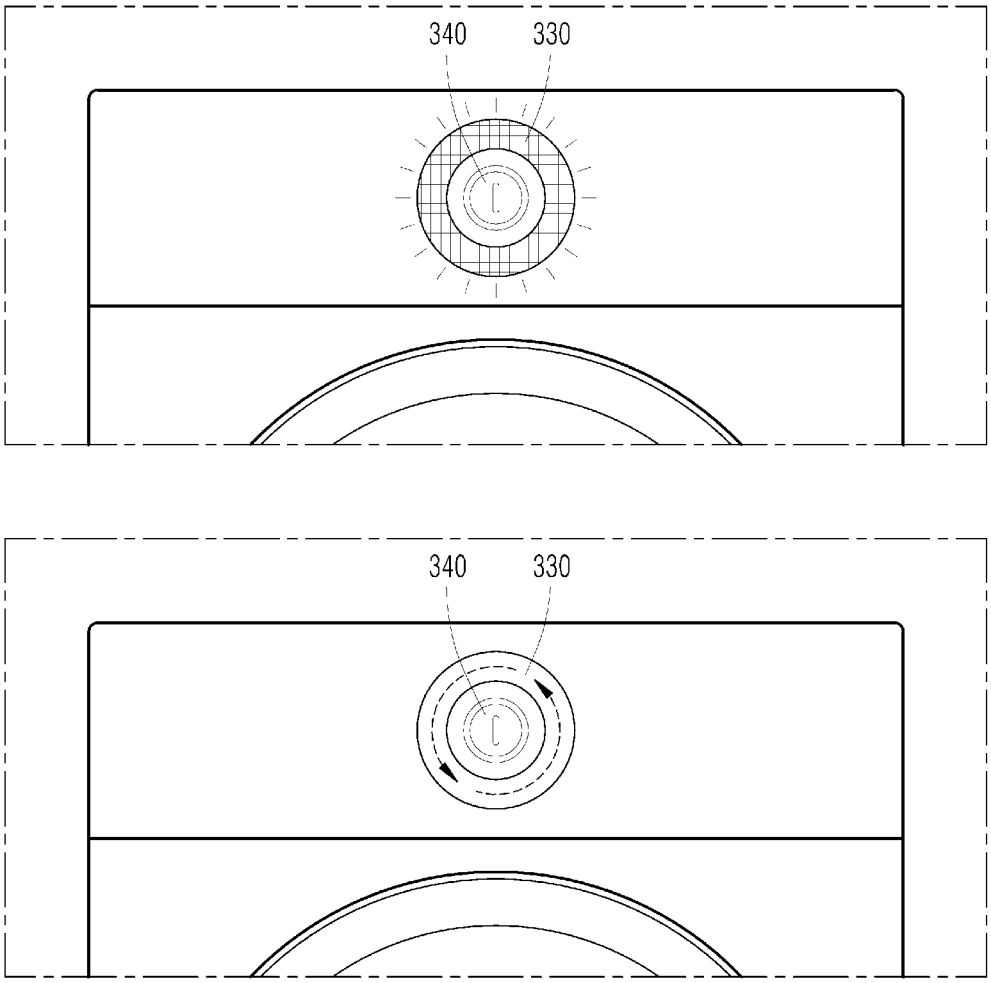
FIG. 14A is a view illustrating an example in which the manipulation interface of FIG. 12 indicates the end of an operation of the washing machine or a situation in which speech is being recognized.
Figure 14B:
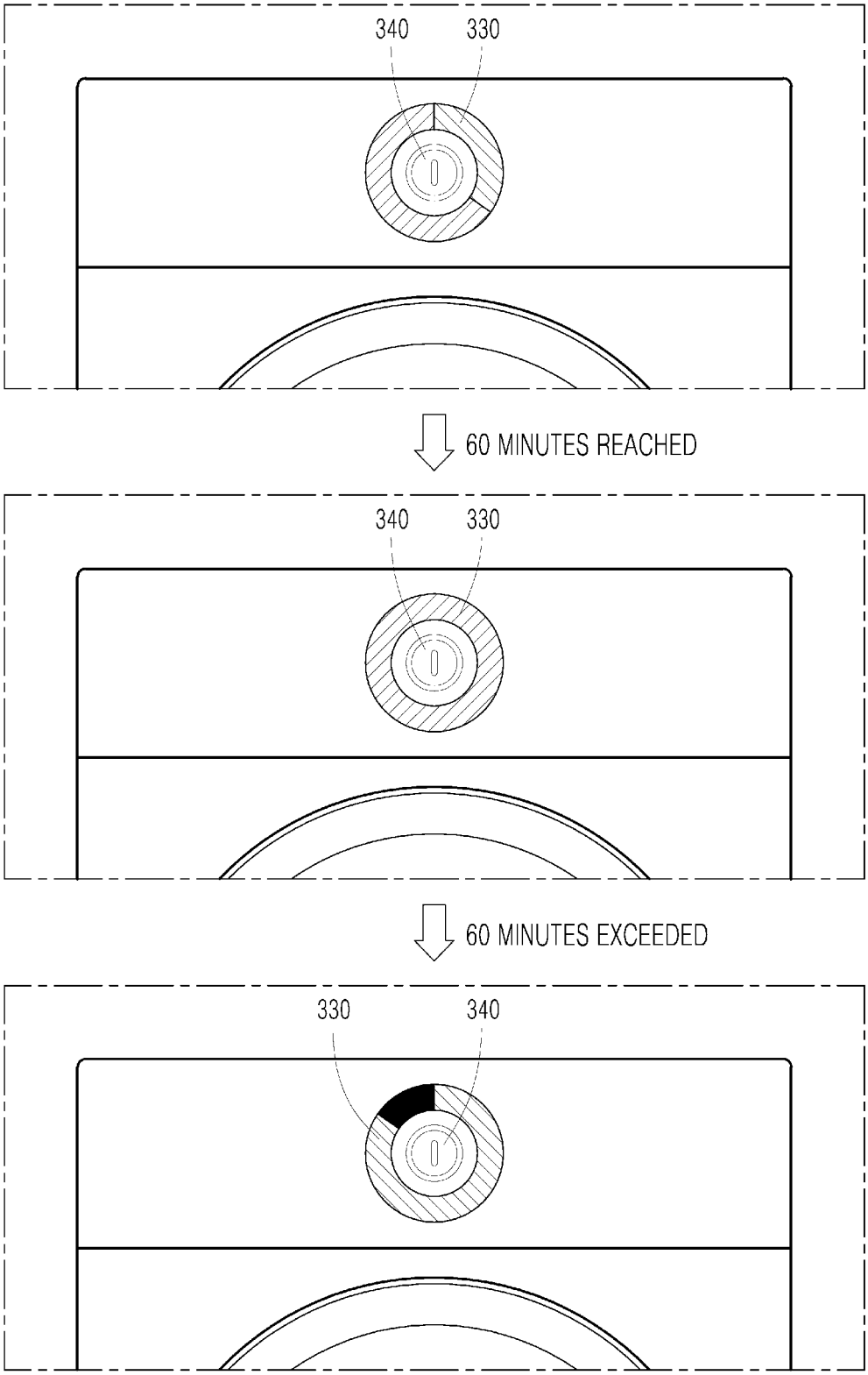
FIG. 14B is a view illustrating an example in which the manipulation interface of FIG. 12 indicates an operating time.

FIG. 14A is a view illustrating an example in which the manipulation interface of FIG. 12 indicates the end of an operation of the washing machine or a situation in which speech is being recognized, and FIG. 14B is a view illustrating an example in which the manipulation interface of FIG. 12 indicates an operating time.

Referring to FIG. 14A, when the lighting 330 may enable lighting with one color, each section of the lighting 330 may be freely lit to indicate blinking or to indicate rotation. Accordingly, the lighting 330 may indicate the end of the operation of the washing machine, a state in which the washing machine is recognizing the speech of the user, or the like.

Further, referring to FIG. 14B, when the lighting 330 may enable lighting freely with one or more colors for each section thereof, the lighting 330 may indicate the operating time of the operation of the washing machine, similar to the indicator 130 of the washing machine according to the first embodiment of the present disclosure described above.

Meanwhile, the washing machine according to the embodiments of the present disclosure may further include a sensor. The sensor may sense when the user approaches the washing machine, and may be composed of a known sensor such as a motion sensor.

The indicator 130, the display 210, the lighting 330, and the power control 140, 340 may be configured to be activated in response to the sensor detecting that the user has approached the washing machine. Therefore, when the user is not located near the washing machine, the light of the washing machine may be turned off and not emit light.

Hereinafter, operations and effects of the washing machine of the present disclosure according to the above configurations will be described in detail.

First, the operation of the washing machine according to the first embodiment of the present disclosure will be described.

When the user performs a touch input on the power control 140 of the washing machine, the power of the washing machine is turned on.

The user may operate the washing machine by speaking the speech command for controlling the operation of the washing machine and then performing a touch input on the input interface 110, or by performing the touch input on the input interface 110 and then speaking the command for controlling the operation of the washing machine. Meanwhile, when the user speaks the command, the indicator 130 or the sound output interface 160 may indicate that the washing machine is recognizing the speech of the user.

When the operation of the washing machine starts, the user may ascertain the control result of the operation of the washing machine by the indication on the indicator 130 or the sound outputted from the sound output interface 160.

Further, when it is necessary to stop the operation of the washing machine while the washing machine is operating, the user may stop the operation of the washing machine by speaking the speech command necessary to stop the operation of the washing machine or by performing a touch input on the input interface 110.

Further, when it is necessary to change the operation of the washing machine while the washing machine is operating, the user may change the operation of the washing machine by, near the washing machine, speaking the speech command necessary to change the operation of the washing machine.

When the operation of the washing machine has ended, the user may ascertain that the operation of the washing machine has ended by the indication on the indicator 130 or the sound outputted from the sound output interface 160, and may open the door 20 to collect laundry. Further, if necessary, the user may turn off the power of the washing machine by performing a touch input on the power control 140.

Next, the operation of the washing machine according to the second embodiment of the present disclosure will be described.

When the user performs a touch input on the power screen 210-1 of the display 210 of the washing machine, the power of the washing machine is turned on, and the power screen 210-1 is changed to the operation screen 210-2.

The user may operate the washing machine by speaking the speech command for controlling the operation of the washing machine and then performing a touch input on the operation screen 210-2, or by performing the touch input on the operation screen 210-2 and then speaking the command for controlling the operation of the washing machine.

The operation screen 210-2 is changed to the indicator screen 210-3 by the touch input of the user. Meanwhile, when the user speaks the command, the display 210 or the sound output interface 160 may indicate that the washing machine is recognizing the speech of the user.

When the operation of the washing machine starts, the user may ascertain the control result of the operation of the washing machine by the indication on the indicator screen 210-3 or the sound outputted from the sound output interface 160.

When it is necessary to stop the operation of the washing machine while the washing machine is operating, the user may stop the operation of the washing machine by speaking the speech command necessary to stop the operation of the washing machine or by performing a touch input on the indicator screen 210-3.

Further, when it is necessary to change the operation of the washing machine while the washing machine is operating, the user may change the operation of the washing machine by speaking the speech command necessary to change the operation of the washing machine.

When the operation of the washing machine has ended, the user may ascertain that the operation of the washing machine has ended by the indication on the indicator screen 210-3 or the sound outputted from the sound output interface 160. When the user opens the door 20 to collect laundry, the screen of the display 210 may be changed to the power screen 210-1. At this time, when the user presses or touches the power screen 210-1 for a long time, the power of the washing machine may be turned off.

Next, the operation of the washing machine according to the third embodiment of the present disclosure will be described.

When the user performs a touch input on the power control 340 of the washing machine, the power of the washing machine is turned on.

After the power of the washing machine is turned on, the user may operate the washing machine by speaking the command for controlling the operation of the washing machine. Meanwhile, when the operation of the washing machine starts, the user may ascertain the operating time of the operation of the washing machine, or the like, by lighting of the lighting 330. In addition, the user may ascertain the control result of the operation of the washing machine by the sound outputted from the sound output interface 160.

Further, when it is necessary to stop or change the operation of the washing machine while the washing machine is operating, the user may stop or change the operation of the washing machine by speaking the speech command necessary to stop or change the operation of the washing machine.

When the operation of the washing machine has ended, the user may ascertain that the operation of the washing machine has ended by lighting on the lighting 330 or by the sound outputted from the sound output interface 160, and may open the door 20 to collect laundry. Further, if necessary, the user may turn off the power of the washing machine by performing a touch input on the power control 340.

As such, in the washing machine according to the present disclosure, the basic operation and the detailed operation of the washing machine may be manipulated using a simple and convenient manipulation interface and speech recognition module. As a result, the user may easily and conveniently manipulate the operation of the washing machine.

In addition, according to the present disclosure, it is possible to simply and conveniently manipulate the operation of the washing machine, so that the user may manipulate the detailed operation without mistakes. As a result, it is possible to prevent the laundry from being damaged.

In addition, according to the present disclosure, the indicator may be disposed with a simple and convenient manipulation interface and be indicated by a graph that may be intuitively and easily recognized. As a result, the user may easily and conveniently recognize information related to the operation of the washing machine.

In addition, according to the present disclosure, the manipulation interface of the washing machine may be configured simply and conveniently. As a result, it is possible to give the user a feeling that the washing machine and the area where the manipulation interface is installed are neat and comfortable.

In addition, according to the present disclosure, the washing machine is provided with the sensor, so that the light of the indicator may be turned off except when the user approaches the washing machine. As a result, it is possible to prevent the user's sleep from being disturbed or fatigue to the user's eyes.

Although the present disclosure has been described in detail with reference to the exemplary embodiments, those skilled in the art may understand that various modifications of the above-described embodiments may be made without departing from the scope of the present disclosure. Therefore, the scope of the present disclosure is not limited to the above-described embodiment but may be defined not only by the following claims, but also by all changes and modification derived from claims and equivalent concepts.

What is claimed is:

1. A washing machine comprising:

an input interface comprising a first button or a first touch panel, the input interface being configured to receive a start or stop signal for starting or stopping operation of the washing machine based on input by a user;

an operation manipulation interface comprising a speech recognition module configured to recognize a sound of the user and a controller configured to control the operation of the washing machine based on the sound recognized by the speech recognition module, the operation manipulation interface being configured to, through the speech recognition module, receive operation signals other than the start or stop signal received through the input interface;

a power control device comprising a second button or a second touch panel, the power control device being configured to turn on and turn off power to the washing machine based on input by the user;

a symbol indicator that includes predetermined characters having first predetermined shapes, respectively, the symbol indicator being configured to indicate one or more operations of the washing machine and to apply at least one of a range of lighting or colors to one or more of the characters while maintaining the first predetermined shapes; and a graph indicator that has a second predetermined shape and is configured to indicate an operating time corresponding to the one or more operations of the washing machine while maintaining the second predetermined shape, wherein the graph indicator has a closed loop shape surrounding at least a portion of a circumference of the input interface and comprising a plurality of sections configured to output light in one or more colors, wherein the symbol indicator is disposed at an outer periphery of the graph indicator, and wherein the graph indicator is configured to, based on the user selecting an operation among the one or more operations, output light through one of the plurality of sections that is located adjacent to a portion of the symbol indicator corresponding to the selected operation.

2. The washing machine of claim 1, wherein the graph indicator is configured to output light in different colors according to an elapse of the operating time of the one or more operations of the washing machine.

3. The washing machine of claim 1, wherein the symbol indicator is configured to output light independently of the graph indicator.

4. The washing machine of claim 1, wherein the symbol indicator is disposed at a side of and adjacent to the graph indicator.

5. The washing machine of claim 1, wherein the input interface has a circular shape, and the graph indicator has a circular ring shape.

6. The washing machine of claim 1, wherein the symbol indicator is configured to indicate a washing operation, a rinsing operation, a spin-drying operation, and a drying operation.

7. The washing machine of claim 1, further comprising a sensor configured to sense the user approaching the washing machine, wherein at least one of the symbol indicator or the graph indicator is configured to be activated in response to the sensor sensing the user.

8. The washing machine of claim 7, wherein the graph indicator is configured to output light based on the speech recognition module recognizing the sound of the user.

9. The washing machine of claim 1, wherein the symbol indicator is configured to indicate a washing operation, a rinsing operation, and a spin-drying operation.

10. The washing machine of claim 9, wherein the symbol indicator comprises a first symbol indicator configured to indicate the washing operation, a second symbol indicator configured to indicate the rinsing operation, and a third symbol indicator configured to indicate the spin-drying operation, and wherein the first symbol indicator, the second symbol indicator, the third symbol indicator are spaced apart from one another and arranged along the circumference of the input interface.

11. The washing machine of claim 2, wherein the graph indicator is configured to:

based on the washing machine starting a washing course that comprises the one or more operations, indicate the washing course in a first color; and based on the washing machine performing a portion of the washing course, change a portion of the graph indicator corresponding to the portion of the washing course to a second color different from the first color.

12. The washing machine of claim 11, wherein the symbol indicator comprises a plurality of symbol indicators that are spaced apart from one another and arranged along the graph indicator, and wherein at least one of the plurality of symbol indicators is configured to output light corresponding to the portion of the washing course.

13. The washing machine of claim 1, wherein the characters comprise words indicating a washing operation, a rinsing operation, a drying operation, and a spin-drying operation, respectively, and wherein the graph indicator has a ring shape located between the words and is configured to change the colors based on a progress of the washing operation, the rinsing operation, and the spin-drying operation.

14. The washing machine of claim 13, wherein each of the words are configured to be lit based on the progress of the washing operation, the rinsing operation, the drying operation, and the spin-drying operation.

15. The washing machine of claim 13, wherein the input interface is surrounded by the graph indicator.

16. The washing machine of claim 15, wherein the power control device is located at a corner of the washing machine and spaced apart from the symbol indicator and the graph indicator.

17. The washing machine of claim 1, wherein the symbol indicator and the graph indicator are spaced apart from each other.

18. The washing machine of claim 1, further comprising:

a main body that defines an outer appearance of the washing machine; and a door coupled to the main body and configured to open and close at least a portion of the main body, wherein the characters of the symbol indicator are disposed at the main body and spaced apart from the door.

* * * * *